United States Patent [19]

Raskin

[11] Patent Number: 4,700,445

[45] Date of Patent: Oct. 20, 1987

[54] METHOD OF MANUFACTURING HEAT TRANSFER PANELS BY INFLATION

[76] Inventor: Rubin Raskin, 127 Remsen St., Brooklyn, N.Y. 11201

[21] Appl. No.: 397,571

[22] Filed: Jul. 12, 1982

[51] Int. Cl.[4] ..... B21D 53/02

[52] U.S. Cl. ..... 29/157.3 V

[58] Field of Search ..... 29/157.3 R, 157.3 D, 29/157.3 V; 165/170; 62/523; 285/176

[56] References Cited

U.S. PATENT DOCUMENTS

| | | | |
|---|---|---|---|
| 2,922,344 | 1/1960 | Meissner | 29/157.3 V |
| 3,126,215 | 3/1964 | Raskin | 285/189 X |
| 3,141,500 | 7/1964 | Raskin | 165/170 |
| 3,911,843 | 11/1975 | Stowell | 29/157.3 V X |

*Primary Examiner*—Howard N. Goldberg
*Attorney, Agent, or Firm*—Eric Y. Munson

[57] ABSTRACT

Method of forming heat exchange panels in which a heat exchange fluid is circulated in flow passages between an inlet coupling and an outlet coupling. A panel is formed by welding together two facially-opposed deformable metal sheets to constitute a front sheet and a back sheet. Either the front sheet or both sheets are provided with a pattern of welded and non-welded areas outlining the flow passages which are expanded or "pillowed" by the injection of a high-pressure medium between the sheets. The method provides for the inflation of the outlined passageway by use of the same couplings and fittings used for the circulation of the heat exchange fluid.

4 Claims, 9 Drawing Figures

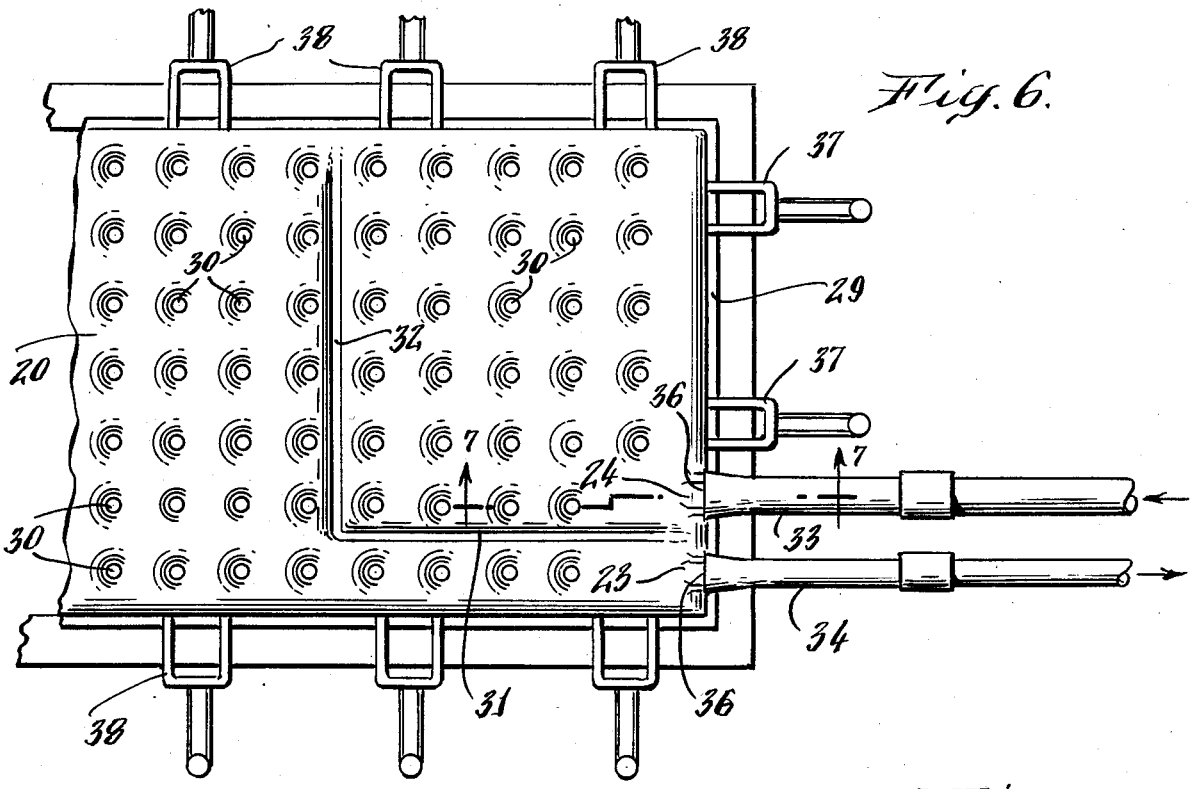
Fig. 6.
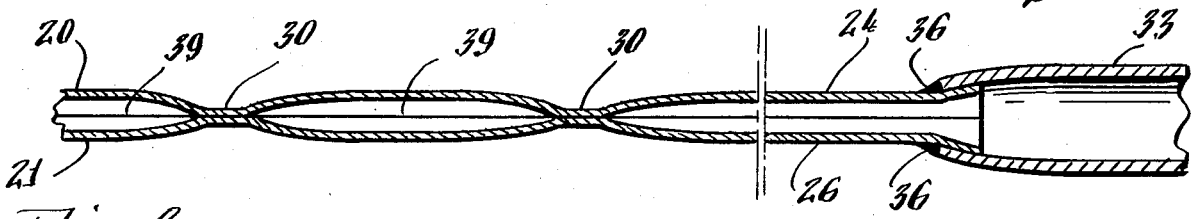
Fig. 7.
Fig. 8.
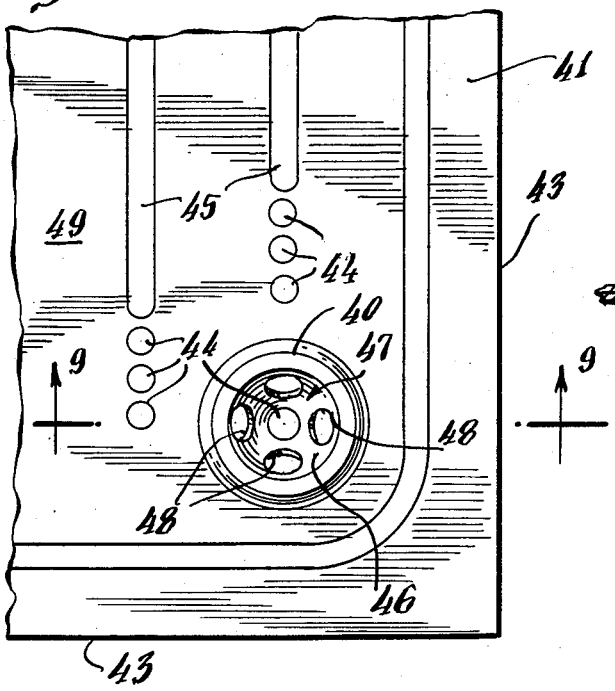
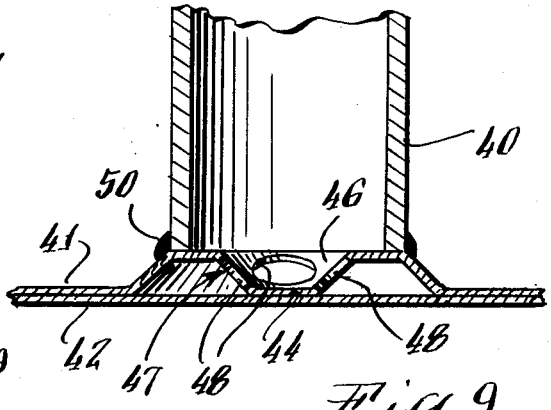
Fig. 9.

METHOD OF MANUFACTURING HEAT TRANSFER PANELS BY INFLATION

FIELD OF THE INVENTION

This invention relates to the manufacture of heat transfer panels composed of a pair of superposed metal sheets which are welded together in face-to-face relationahip at different places so as to define passageways for the heat exchange fluid which circulates therethrough. Examples of the type of heat exchange panels to which the invention is particularly applicable are shown in U.S. Pat. Nos. 2,626,130, 3,335,789 and 4,002,200. Specifically, the invention relates to a method of forming the pattern for the fluid passageway by the so-called inflation process.

BACKGROUND OF THE INVENTION

In the conventional manner of making heat exchange panels, pair of superposed metal sheets are welded together at different places to form a desired pattern of passageways. Spot welds may be used to form a flooded type heat exchange panel, while seam welds may be used to form a serpentine passage way in the panel. Either type of weld may be made in one or both of the metal sheet by conventional welding methods, such as the plug welding or the resistance welding method, in which the metal sheets are pressed together with two electrodes, or by the inflation method, in which the pattern is painted on one or both of the sheets with a nonbonding or weld-preventing composition, usually consisting of a mixture of graphite in water glass, and the two sheets are then welded together by the conventional hot rolling process. The latter method is described in U.S. Pat. Nos. 2,680,002, issued Sept. 28, 1954 and 2,982,013, issued May 2, 1961. Another example or the prior art is described in U.S. Pat. No. 1,709,865, issued Aug. 23, 1929. After the sheets have been welded together with the desired pattern outlined on one or both of the sheets, the double-surfaced blank is placed on a stretcher table with the opposing welded edges held in clamped position under slight tension. A high pressure fluid is then injected through an opening formed between the two sheets and a high pressure tube welded thereto to distend the non-welded area ot the blank and thus form the selected pattern of passageways for the heat exchange fluid to be supplied through openings subsequently formed in the blank by means of special fittings and couplings connected to an inlet duc and an outlet duct, respectively, in the completed article.

In the spot-welded version, or flooded type, of heat exchange panel, the distended area of the blank assumes a "pillowed" effect. The degree of fluid pressure required to distend the non-joined area of the blank and to cause the "pillowed" effect, will, of course, vary with gauge and composition of the metal used. As an example, the heat exchange panel manufactured by Dean Products, Inc., identified as "Panelcoil"900 series, is made of 12–18 gauge stainless steel and requires an inflation pressure if 300 PSIG to 400 PSIG to obtain a "pillow" height on both sides of the facing sheets averaging between 0.120" to 0.150" and designed for operating pressures between 50 PSIG and 500 PSIG. In heat exchange panels where only one of the superposed sheets is embossed, the non-embossed sheet obviously must be heavier gauge, in order to withstand the aforementioned inflation pressure.

Conventionally, after the sheet metal blank has been inflated or "pillowed", the metal in one or both of the sheets is distorted or pried apart to form an inlet and an outlet for the heat exchange fluid to be circulated through the heat exchange panel, and the inlet opening for the inflation fluid is sealed. These inlets and outlets must be sufficiently large to accommodate the pipe fittings for the source of heat exchange fluid to supply this fluid in sufficient volume to flood the passageways in the heat exchange panel. To ensure complete flooding of the passageways, the outlet opening preferably is of smaller dimensions than the inlet opening, to create the required operating pressures. These operating presures may vary between 50 PSIG and 1000 PSIG, depending on the type of metal used and the thickness thereof, which pressures may cause weakening or distortion of the passageways, or even cause separation between the two facing sheets, Heretofore, it was not thought possible to inject the high pressure fluid through the same fittings or couplings that are used for circulating the heat exchange fluid, because the high stress created by the large volume of high pressure inflation fluid would cause the welds to "blow" . Thus, according to U.S. Pat. No. 1,709,865, supra, the normal inlet fitting for the heat exchange fluid is replaced by a separate pipe for introducing the inflation fluid, while the outlet opening for the heat exchange fluid if plugged. According to U.S. Pat. No. 2,690,002, supra, a hole is drilled into the passageway for the heat exchange fluid after the expansion process is completed, which hole is fitted with a tube to allow circulation of heat exchange fluid through the heat exchange panel. See also U.S. Pat. No. 3,512,239, which suggests the formation of another opening after the inflation process has been completed, which opening, along with the opening for introducing the hydrostatic pressure between the plates, provides for flow of heat exchange fluid through the passageways.

The applicants have now made the unobvious discovery that by using couplings substantially as disclosed in U. S. Pat. Nos. 3,126,215 and 3,141,500, granted to the common assignee of this application, heat exchange panels can be produced economically without the use of a separate fitting for the inflation fluid.

Other examples of prior are are shown in U.S. Pat. Nos 3,512,239 and 3,736,783 .

SUMMARY OF THE INVENTION

The object of the invention is to directly inflate the embossed pattern through the same portholes and fittings which are used for admitting the heat exchange fluid.

BRIEF DESCRIPTION OF THE DRAWING

FIG. 6 is a fragmentary view showing the sheets of FIG. 5 clamped on a stretch leveller in position for inflation.

FIG. 7 is a partial cross section of the inflated sheets.

FIG. 8 is a face view of a portion of a heat exchange panel with another type of fitting applied thereto.

FIG. 9 is a cross section taken along the line 9—9 of FIG. 8 seen in the direction of the arrows.

DETAILED DESCRIPTION OF THE INVENTION

Figure 1:
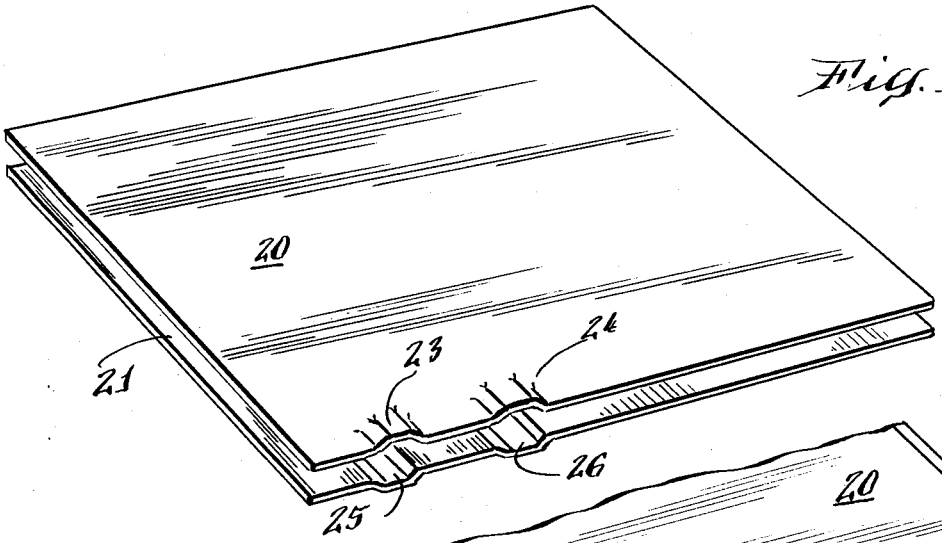
FIG. 1 is an end elevational view of two sheets adapted to welded together.
Figure 2:
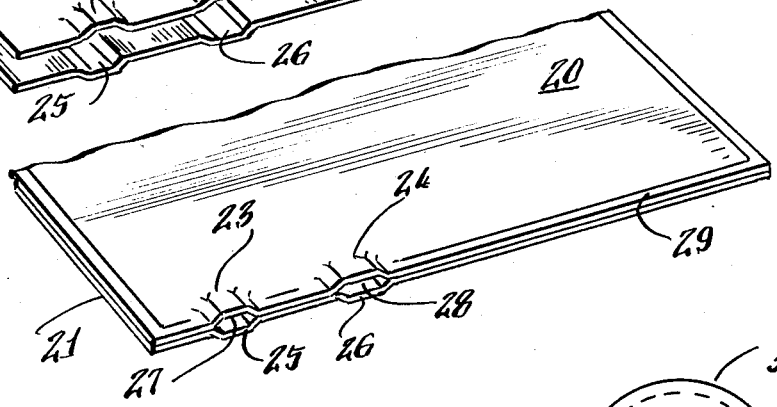
FIG. 2 is a fractional and elevational view of the two sheets of FIG. 1 positioned together for welding.

Referring to the drawings, the heat exchange panel is made from metal sheets 20 and 21. Both of the sheets 20 and 21 are stamped or otherwide processed to form embossed portions 23, 24, 25 and 26 on the respective sheets. When the two sheets are placed together, in face-to-face relationship with their surfaces in contact with one another, as shown in FIG. 2, the embossed portions form openings 27 and 28 between the two sheets. In the embodiment shown, the openings have a hexagonal contour, but it should be understood that the sheet may be stamped to form openings of the shapes. The two facing sheets are then welded together by the conventional spot and seam welding method to form the outline of the desired pattern of passageways for the heat exchange fluid. In the embodiment shown in FIG. 3, the two metal sheets 20 and 21 are of equal material and thickness and are welded together to form a continuous weld 29 framing the central portion of the sheets, which is provided with a number of spot welds 30 and seam welds 31, 32 to create a so-called full-flow or flooded pattern.

It should be understood, however, that the invention is not restricted to any particular flow pattern and may embody patterns such as those shown in U.S. Pat. Nos. 3,141,500, 2,626,130, 4,002,200 and 3,335,789.

Figure 3:
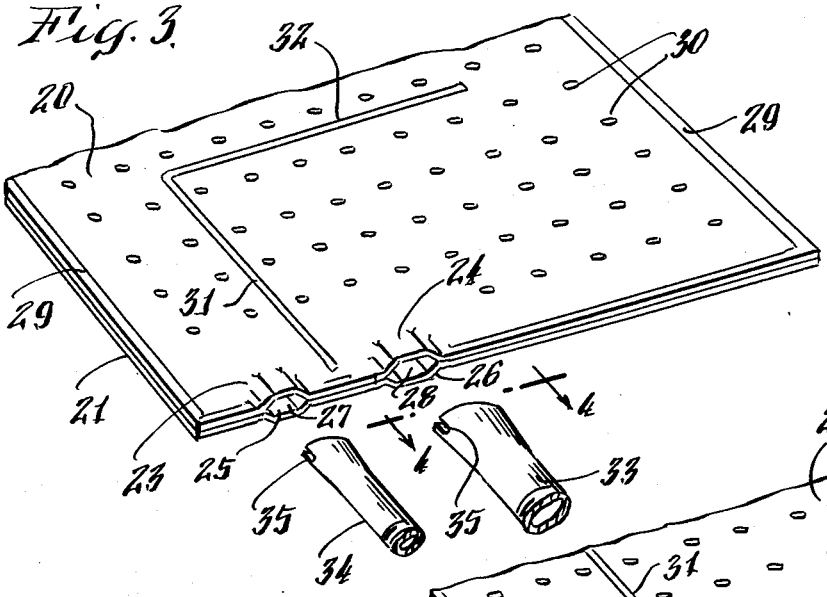
FIG. 3 is a fractional and elevational view of the two sheets welded together with the pipe fittings for the heat exchange fluid in position to be applied to the portholes in the welded sheets.
Figure 4:
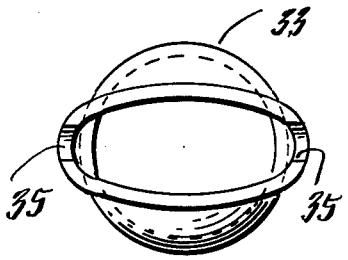
FIG. 4 is a cross section taken substantially on line 2—2 of FIG. 3, looking in the direction of the arrows.
Figure 5:
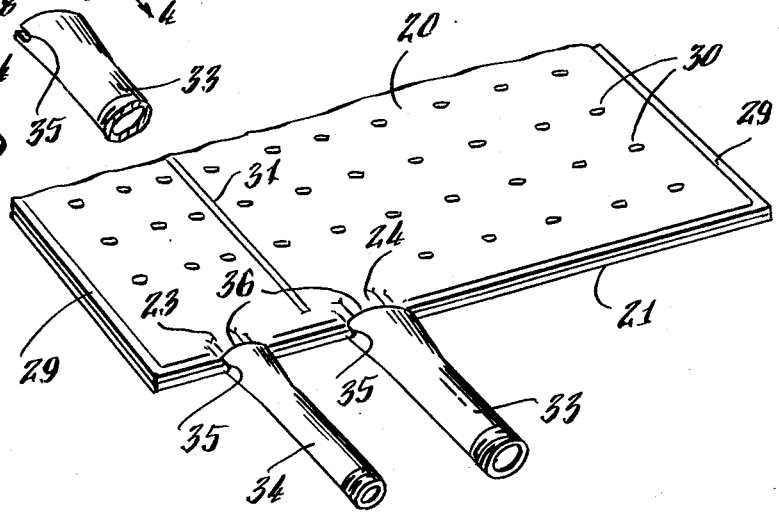
FIG. 5 is a view similar to FIG. 3, showing the fittings in position on the welded sheets.

After the metal sheets are welded together, slip-over couplings 33 and 34, shown in FIGS. 3,4 and 5, are applied to the openings 27 and 28. Each of these couplings consists of a metal sleeve externally threaded at the end opposite the end applied to the openings 27 and 28, to be connected either to a pipe supplying the high pressure hydraulic fluid (not shown) or to the pipe supplying the heat exchange fluid (not shown). The end of the couplings applied to the openings 27, 28, is necked down and shaped so as to slide snugly over these openings and is provided with diametrical opposite slots which telescope over the edge portion of superposed sheets 20 and 21, as shown in FIG. 5.

It will thus be clear that the shape and construction of the couplings 33 and 34 is such that they can readily be telescopical fitted over the edges of the two facing sheets. When fitted in position over the edges of the sheets, they may be welded in place as indicated at 36 in FIGS. 5 and 6.

After the application of the couplings 33 and 34 to the two facing and welded-toghther sheets, the resultant panel is placed in the opposing jaws or clamps 37, 38 on a support (not shown), with the two sheets in superposed position as shown in FIG. 6. The clamping arms are movable towards and away from one another in response to the application of stress on the panel.

While the panel is held underrestraint between the clamping arms, hydraulic fluid, such as oil, air or other gaseous medium, is pumped into one of the couplings or otherwise sealed and force in between the spot welds 30 to separate the unwelded area of the two sheets to separate them from one another and to cause them to "pillow" and form pockets 39, as shown in FIG. 7. With the pockets being in direct communication with one another, the panel becomes a flooded type of heat exchanger, in which the heat exchange fluid is caused to flow at random.

After the inflation or "pillowing" of the two sheets, the plugged or sealed coupling is unsealed, and the resultant panel is now ready for use as a heat transfer surface, simply by connecting both of the couplings to a source of heat exchange fluid (not shown Preferably, the couplings are of slightly different dimension Thus, the coupling of the narrower dimension may be selected as the high pressure port for the hydraulic fluid, while the coupling of the larger dimension may be selected as the entry port for the heat exchange fluid, to ensure adequate flooding of the panel as the fluid is circulated towards the narrower outlet coupling.

In the modification shown in FIGS. 8 and 9, the coupling 40 may be used both as a high pressure port for the hydraulic fluid and as an inlet or an outlet for the heat exchange fluid. The embossed sheet 41 is welded to the back sheet 42. Additionally, the sheets 41 and 42 are also welded together at their marginal edges 44 and provided with spot welds and seam welds 45, to define flow passages 49. The coupling 40 is secured to the sheet 41 directly over the dimple 46 and spot weld 44. The dimple 46, together with the surrounding wall 47, forms a dam having a plurality of openings or ports 48. Four of these ports are shown, but it should be understood that this number may be increased or decreased according to the requirements. The ports are arranged so that they serve to establish communication between the coupling 40 and the flow passages 49. These ports also make it possible to inflate or "pillow" the unwelded arc defining the flow passage directly through the coupling 40, since the back sheet 42 is supported by the spot weld 44 and thus is prevented from bulging during the inflation step.

The coupling 40 may be secured to the embossment on the sheet 41 by welding as shown at 50.

It should be understood that the invention is not restricted to the specific examples described herein, but may be applicable to a variety of form exchange plates within the scope of the appended claims.

I claim:

1. In the method of forming heat exchange panels in which a fluid heat exchange medium is circulated in flow passages between an inlet coupling and an outlet coupling, both of which are adapted for connection to respective supply pipes, said panel being formed by welding together two facially opposed deformable metal sheets constituting a front sheet and a back sheet, respectively, at least the front sheet being providing with pattern of welded and non-welded areas outlining said flow passages, in which method a fluid high pressure medium is injected between said sheets while they are restrained in position, to expand said non-welded areas to form said flow passages, the improvement comprising the steps of:

(a) forming an inlet opening and an outlet opening for said fluid media by embossing walled depressions to serve as inlet opening and outlet openings, respectively in said front sheet in an area where it is welded to said back sheet;

(b) making openings in the walls of said depressions to establish communication with said flow passages;

(c) applying a pattern of welded and non-welded areas to at least one of said sheets to define flow passages therebetween for said fluid media;

(d) fitting a coupling over said inlet and outlet openings for connection to asid supply pipes;

(e) admitting high pressure medium through one of said couplings at a volumetric pressure calculatled to expand said non-welded areas into said flow passages while maintaining the other one of said couplings sealed; and (f) unsealing the other one of said couplings upon completion of the expansion step.

2. In the method of forming heat exchange panels in which a fluid heat exchange medium is circulated in flow passages betwqeen an inlet coupling and an outlet coupling, both of which are adapted for connection to respective supply pipes, said panel being formed by welding together two facially opposed deformable metal sheets constituting a front sheet and a back sheet, respectively, at least the front sheet being provided with a pattern of welded and non-welded areas outlining said flow passages, in which method a fluid high pressure medium is injected between said sheets while they are restrained in position, to expand said non-welded areas to form said flow passages, the improvement comprising the steps of:

(a) embossing at least one of said sheets adjacent to one edge portion thereof to form polygonally contoured tapering inlet and outlet opeings, respectively, for said fluid media then said sheets are welded together;

(b) applying a pattern of weldeld and non-welded areas to at least one of said sheets to define flow passages therebetween for said fluid media;

(c) sliding a tubular coupling having a polygonally contoured end portions matching said inlet and outlet openings and provided with diametrically opposite slots, over the inlet openings and the outlet openings, to allow a substantially unobstructured and smooth flow of fluid media from said supply pipes into said flow passages;

(d) welding said couplings in place;

(e) admiting high pressure medium through one of said couplings at a volumetric pressure calculated to expand said non-welded areas into said flow passages while maintaining the other one of said couplings sealed; and (f) unsealing the other one of said couplings upon completion of the expansion step.

3. The method according to claim 2, in which the coupling selected for admitting high pressure medium has a narrower dimension than the other one of said couplings.

4. The method according to claim 3, in which said other one of said couplings is selected as the entry port for the neat exchange fluid.

* * * * *